United States Patent [19]

Regler et al.

[11] 4,161,167

[45] Jul. 17, 1979

[54] LAP CUTTING BLADES

[75] Inventors: Dieter Regler; Alfred Moritz, both of Burghausen, Fed. Rep. of Germany

[73] Assignee: Wacker-Chemitronic Gesellschaft für Elektronik Grundstoffe mbH, Burghausen, Fed. Rep. of Germany

[21] Appl. No.: 897,837

[22] Filed: Apr. 19, 1978

[30] Foreign Application Priority Data

May 20, 1977 [DE] Fed. Rep. of Germany ..... 2722779

[51] Int. Cl.[2] ..... B28D 1/00; B28D 1/08

[52] U.S. Cl. ..... 125/18

[58] Field of Search ..... 125/16, 18, 12, 21; 51/59 R, 204; 407/120

[56] References Cited

U.S. PATENT DOCUMENTS

| | | | |
|---|---|---|---|
| 791,157 | 5/1905 | MacNutt | 125/18 |
| 3,176,675 | 4/1965 | Bomba | 125/18 |

FOREIGN PATENT DOCUMENTS

| | | | |
|---|---|---|---|
| 464270 | 6/1951 | Italy | 125/18 |
| 466008 | 10/1951 | Italy | 125/18 |
| 515343 | 2/1955 | Italy | 125/18 |
| 24322 | 11/1904 | United Kingdom | 125/18 |

*Primary Examiner*—Harrison L. Hinson

*Attorney, Agent, or Firm*—Allison C. Collard; Thomas M. Galgano

[57] ABSTRACT

Lap cutting blades are provided which are useable for the multiple lap cutting of solid materials, such as semiconductorrods. The blades each have a generally rectilinear cutting edge, the length of which is 1–75 times the thickness of the blade, as measured at its cutting edge. The cutting edge of each blade has rectilinear edge portions separated by a plurality of notched edge portions which, in turn, define a plurality of recesses which encompass 5 to 25% of the total blade length and 5 to 40% of the effective operating length of the blade. The notched blade edge portions define a notch angle of between 20 and 80 degrees, as measured between the tangent thereto at its point of intersection with the rectilinear cutting edge portion and a line perpendicular to the rectilinear cutting edge portion.

12 Claims, 4 Drawing Figures a
10
11
11
12
13
13
14
15
15
16
17
17
α
α
α
α
b
b
b
b
$b_a$
$b_a$
$b_m$

LAP CUTTING BLADES

This invention relates to a method for the multiple lap cutting of solid materials, wherein a set of blades are moved in a lateral reciprocating movement under the influence of a defined pressure through the solid material to be cut by means of a suitable lapping medium suspension or sludge. During the cutting operation, a pressure force of 100 to 1000 p for each blade is exerted. The free operating length of the blades is in the range of 110 to 250 mm. Shorter blades should be selected if the pressure force is to be increased. The set of blades during cutting is moved laterally through the solid material in a medium lateral movement of 30 to 150 m per minute.

It is an object of the subject invention to provide optimum lap cutting blades to carry out the above process.

The set of blades which are used in frame saws or multiple lap cutting machines for cutting semiconductor materials, for example, silicon or germanium or oxidic substances like sapphires or rubies consist of a plurality of individual blades which are clamped in a frame and spaced apart from each other by means of spacer disks. These individual blades are essentially metal strips having a rectangular cross section and are made of steel. The blades are smooth and uncoated, and are fed with high speed over the solid material to be cut. The actual cutting effect is the result of a lap cutting powder sludge or suspension which contains a cooling agent so that the cutting powder may be, for example, silicon carbide or diamond powder. These known smooth blades have the disadvantage that a relatively low amount of lap medium is drawn into the saw slit because of the smoothness of the blades. A further disadvantage is that during pressure exertion onto the blade, the lap cutting medium is pushed between the vertical side walls of the blades and the work piece, and is moved by the blade into the solid material to be cut. This results in an undesirable widening of the saw slit, and thereby in undesirable cutting losses of the solid work material. A further disadvantage of these blades is that the sawing process has to be interrupted and can only be resumed after the stroke is shortened. The reason is that the lap cutting mediums used are not only harder than the solid material which has to be cut, but is also harder than the cutting blade. This results in an increasing wear of the blade. This wear is step-like, whereby the steps are shaped at the beginning and at the end of the blade portion during the sawing through of the solid material.

At a defined height of these steps, the edges of the cut semiconductor disks break. The saw thus has to be stopped and the stroke shortened in order to prevent the cut semiconductor disk edges from breaking. For shorter strokes a shorter blade range is moved through the solid material in a reciprocating fashion until steps begin to form again at the front and rear end of the blade range. At this point, the saw is again stopped and the stroke is shortened further. The constant shortening of the stroke and the essentially same lateral speed of the shortened blade movement in the crystal results in longer duration of the blade in the crystal, which in turn results in wedge shaped disks, that is, disks wherein the thickness is reduced in a direction perpendicular with respect to the cutting direction. This increasing lateral displacement is increased due to the longer sawing time required caused by the constant shortening of the stroke, since in this process, longitudinal rod-like cutting elements are present in the normally almost cubical cutting elements in the lap cutting medium. It is therefore an object of the present invention to find a lap cutting blade which overcomes the aforementioned disadvantages of commonly known cutting blades.

This object of the invention is achieved in that recesses are provided on the lower edge of the blades, the length of which are 1–75 times that of the blade thickness measured at the cutting edge of the blade. The recesses occupy 5–40% of the free operating length of the blade and 5 to 25% of the blade length. The blade edge which defines the recesses or the adjacent tangent encompasses a notch angle of 20° to 80° at the point of intersection with the cutting edge, and a line perpendicular to the cutting edge. In the preferred embodiment of these lap cutting blades the measured length of the individual recesses in the cutting edge of the blades are 10 to 20 times that of the blade height, and the recesses on the lower side of the blade occupy about 25 to 35% of the free operating length of the blades. Furthermore, it had been shown that it is advantageous that the recesses be a maximum of 10 to 20% of the blade height.

The blade edge which defines the recesses, or in the case of a curved recess the tangent line which is adjacent with the point of intersection of the cutting edge, preferably forms with a line perpendicular to the cutting edge, a notch angle of 40° to 70°.

The spacing of the individual recesses in the lap cutting blade may be randomly chosen. For example, the space between two recesses may be continually shortened in the direction of the center of the blade and may be increased from the center of the blade to the end of the blade. However, in a preferred embodiment, the spacing of any two recesses is equal.

The individual blades have a free operating length of about 110 to 250 mm, preferably, 180 to 220 mm, so that shorter blades should be used in cases where the pressure forces are increased in order to prevent the blades from bending. Low cost types of steel are available for the blade material, for example, spring steel having a tensile strength of about 120 to 250 kp per $mm^2$, preferably, 200 to 240 kp per $mm^2$. It is to be understood that the free operating length of the blade means the blade portion which is freely clamped between the retaining elements and which is moved through the material to be cut. Thereby, the height of the blade is about 5 to 10 mm, particularly favorable is the dimension of about 5–7 mm having a thickness of about 100–300 $\mu$m. When choosing the blade thickness, the value should be as low as possible, essentially about 150 to 250 $\mu$m, so as to limit the cutting losses. The inventive lap cutting blades are not only advantageous in the method of the present case, but improve other methods for lap cutting, so that blades of different dimensions may be used.

Other objects and features of the present invention will become apparent from the following detailed description when taken in connection with the accompanying drawings which disclose the embodiments of the invention. It is to be understood that the drawing is designed for the purpose of illustration only, and is not intended as a definition of the limits and scope of the invention disclosed.

In the drawing, wherein similar reference numerals denote similar elements throughout the several views.

Figures 1, 2, 3, 4:
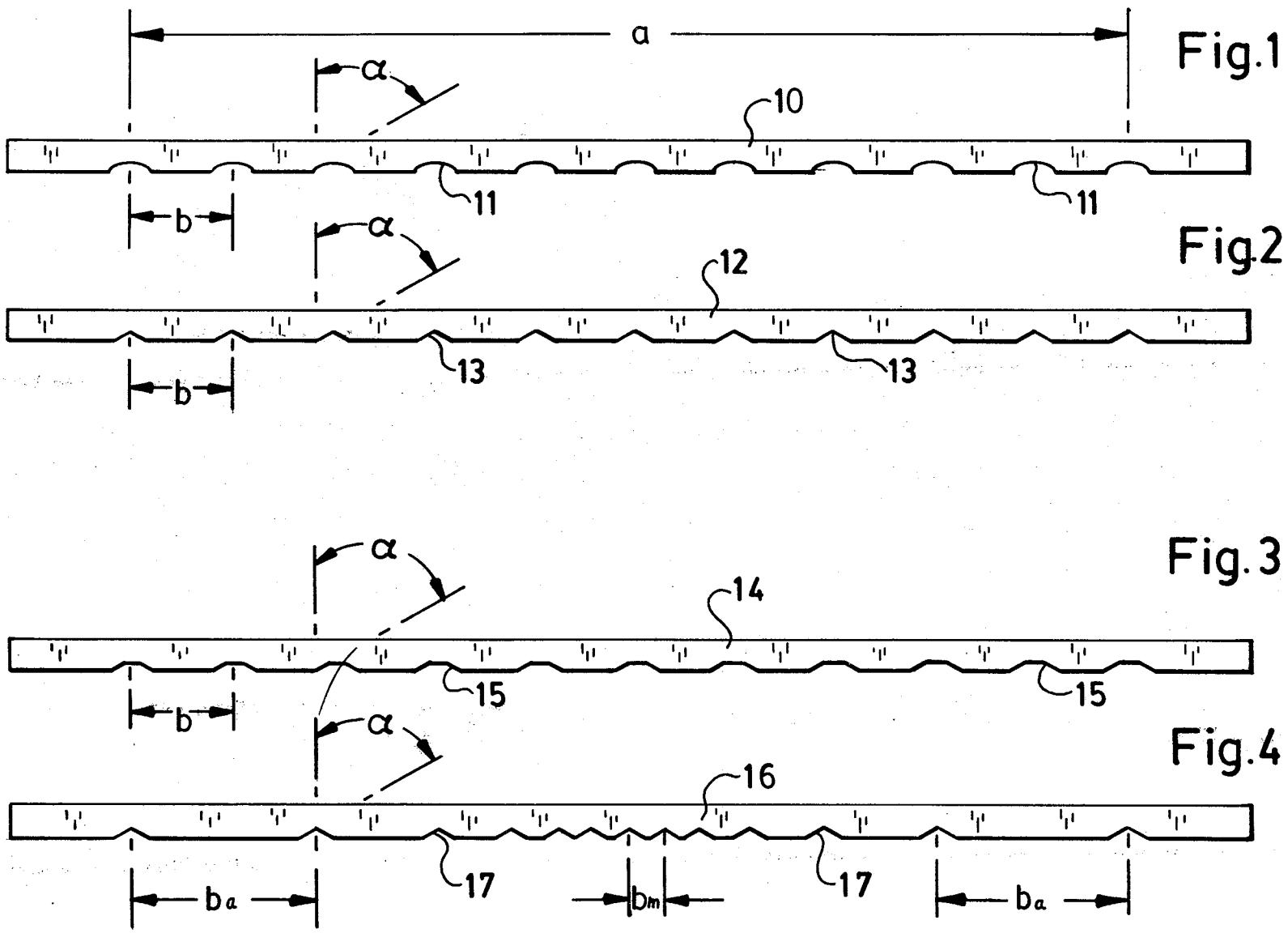
FIG. 1 shows a lap cutting blade with curved recesses according to the invention.
FIG. 2 shows a lap cutting blade with recesses in shape of a triangle according to the invention.
FIG. 3 shows a lap cutting blade with recesses in shape of a trapezoid according to the invention.
FIG. 4 shows recesses in shape of small triangles wherein the spacing between adjacent recesses is varied.

Referring to FIG. 1 there is shown a blade 10 with curved recesses 11 which are equally spaced apart by a distance "b" from each other. Recesses 11 may be easily milled into the previously straight cutting edge by means of a spherical cutter. The cutter head is mounted with diamond chips. The angle $\alpha$ shown in FIG. 1 constitutes the notch angle, and is defined by a line perpendicular to the cutting edge of the blade and a line tangent to the curve at the point of intersection of the curve with the straight portion of the cutting edge. The path "a" constitutes the free operating length of the blade portion which is moved in the crystal. Generally, the reversal point during sawing is maintained between the apex of the first and last recess.

FIG. 2 shows a cutting blade 12 wherein the recesses 13 are in the shape of a triangle. In this Fig. the space "b" between two recesses is also equidistant. The notch angle $\alpha$ in this case is defined by a line perpendicular to the cutting edge on the one hand, and the ascending edge of the triangular recess on the other hand.

FIG. 3 shows a blade 14 with a cutting edge 15 having a trapezoidal-like cross section. The distance "b" between any two recesses is also equal in distance from each other. The notch angle is defined by a line perpendicular to the cutting edge, on the one hand, and the ascending edge of the trapezoid on the other hand.

FIG. 4 shows a blade 16 similar to FIG. 2. However, in this case the spacing between two adjacent recesses 17 is not equal but starts with a value "$b_a$" at each end of blade 16. Toward the center of blade 16, the spacing between recesses decreases to a minimum value "$b_m$" at the center of the blade. Due to the recesses provided in the inventive lap cutting blades, free spaces are created in the cutting edge so that the cutting granules of the lap cutting medium can accumulate during sawing. These granules are fed over the straight portion of the blade during the reciprocating movement when the solid material is sawed and thereby cut the solid material due to the generated abrasion. The granules of the lap cutting medium can escape into these free spaces when pressure is exerted on the blades, and are not forced between the vertical side walls of the blade and the saw slit. Thereby, a smaller saw slit is obtained with respect to the known lap cutting blades. Moreover, the step-like wear caused by the lap cutting medium in conventional blades is prevented due to the recesses in the blades, and the fact that there is a point of reversal provided in the apexes of the end recesses. Therefore, it is not necessary to stop the frame saw or the lap cutting machine during sawing in order to shorten the stroke. This results in a decrease in operating time and also prevents longitudinal or rod-like particles, which may be present in the lap cutting medium from becoming disadvantageously effective. Hence, the advantage of the use of the inventive lap cutting blades is that, in a shortened sawing time there is a low cutting loss, and better quality disks are obtained.

COMPARISON EXAMPLE 1

A monocrystalline silicon rod having the dimensions of 50×50×220 mm was sawed into disks laterally with respect to the longitudinal axis, using a frame saw of Firma Meyer & Burger Ag, Steffisburg, Switzerland, Type GS 1. The set of blades consisted of 240 blades having a thickness of 200 mm, a height of 6 mm and a free operating length of 355 mm. After the blades were applied to the silicon rod, they were guided in common manner with a low lateral speed of a few meters per minute over the crystal without exerting any pressure. When all the blades engaged the silicon rod, then the lateral speed with which the set of blades is guided was increased to 27 m per minute and maintained until the sawing process was completed. During the sawing operation, a pressure force of 60 p per blade was exerted. After a sawing time of 3 hrs, the saw was stopped and the stroke was shortened by about 6 mm. This change in stroke took only 15 minutes. Since the lateral speed of the blades over the silicon rod remained constant, there was a reduction of the saw speed. Therefore, the blades remained for a longer duration in the crystal and due to the time dependent substrate wear, the saw slit became wider during the progressive sawing operation, that is, the sawed out disks became thinner. The lap cutting medium in this case was silicon carbide having a granule distribution between 10 to 50 $\mu$m, and was converted into a sludge or suspension in a mineral oil having a viscosity of 45 cp. After a sawing time of 24.5 hours and a conversion time of 2 hours caused by stopping the machine for shortening the stroke, 239 disks were obtained having a thickness of about 470 $\mu$m. The wedge error of the disks had a dimension of 12 $\mu$m/cm, measured perpendicular with respect to the cutting direction, that is, in direction of the saw feeding. The cutting capacity with respect to the sawing time without considering the conversion time for changing the stroke was about 0.017 $cm^2$ per minute and blade.

COMPARISON EXAMPLE 2

A monocrystal silicon rod having the dimensions 50×50×220 mm was sawed into disks laterally with respect to the longitudinal axis using a lap cutting machine. The saw was a lap cutting machine which essentially corresponded to a frame saw of Firma Meyer & Burger Ag, Steffisburg, Switzerland, type GS1. However, the machine was altered in such a manner that shorter blades could be moved with higher speed and under higher pressure. The set of blades consisted of 240 blades having a thickness of 200 $\mu$m, a height of 6 mm and a free operating length of 200 mm. The cutting surface was smooth. After the blades engaged the silicon rod, they were first moved in a low lateral starting speed of a few meters per minute without exerting hardly any pressure. Then, the lateral speed with which the set of blades was guided over the silicon rod was increased to 45 m/min. During the sawing operation, a pressure force of 180 p per blade was exerted. The lap cutting medium was silicon carbide having a granular distribution of 27 to 30 $\mu$m which was converted into sludge or suspension in mineral oil having a viscosity of 45 cp, whereby 1 part by weight silicon carbide was added to 3 parts by weight of mineral oil.

After 45 minutes of sawing, the saw had to be stopped since steps were formed in the blade at the reversal points due to abrasion, which would have resulted in wall breaks in the silicon disks if sawing would have continued. After shortening the stroke by about 6 mm, sawing was restarted after 15 minutes, which was needed for converting to the shorter stroke.

After a pure sawing time of 2.6 hours, 239 disks were obtained having a thickness of 470 μm in perpendicular direction to the disk axis. This corresponds to a cutting capacity of 0.16 $cm^2$ per minute and blade.

EXAMPLE

The method was analogous to comparison example 2 with the exception that the cutting edge of the blades used had curved recesses as measured in the cutting edge, 6 mm length and a height in the apex of 1 mm. A total of 20 such recesses were distributed in equal spacing over the total length of the blade so that the reversal points during sawing were positioned in the apex points of the two end recesses. The sawing operation did not have to be interrupted. After a sawing time of 2.08 hours, 239 disks having a thickness of 480 μm were obtained. The disks were not wedge shaped. The cutting capacity was 0.2 cm per minute and disk.

While several embodiments of the present invention have been shown and described, it will be obvious to those persons of ordinary skill in the art, that many changes and modifications may be made thereunto, without departing from the spirit and scope of the invention.

What is claimed is:

1. A lap cutting blade usable for the multiple lap cutting of solid materials comprising:

an elongated lap cutting blade having a generally rectilinear cutting edge, the length of which is 1–75 times the thickness of the blade, as measured at its cutting edge, said cutting edge having rectilinear edge portions separated by a plurality of notched edge portions which, in turn, define a plurality of recesses which encompass 5 to 25% of the total blade length and 5 to 40% of the effective operating length of the blade and which each have a length between 10 to 20 times the blade thickness and wherein said notched blade edge portions define a notch angle of between 20 and 80 degrees, as measured between the tangent thereto at its point of intersection with said rectilinear cutting edge portion and a line perpendicular to said rectilinear cutting edge portion.

2. A lap cutting blade according to claim 1, wherein said recesses encompass about 25 to 35% of the effective operating length of said blade.

3. A lap cutting blade according to claim 1, wherein said recesses encompass 10 to 20% of the blade height.

4. A lap cutting blade according to claim 1, wherein said notch angle defined by said blade edge portions encompasses an angle of between 40 to 70 degrees.

5. A lap cutting blade according to claim 1, wherein said recesses are equidistantly spaced apart.

6. A lap cutting blade according to claim 1, wherein said blade has a thickness of 150 to 250 μm.

7. A lap cutting blade usable for the multiple lap cutting of solid materials comprising:

an elongated lap cutting blade having a thickness of 150 to 250 μm and having a generally rectilinear cutting edge, the length of which is 1–75 times the thickness of the blade, as measured at its cutting edge, said cutting edge having rectilinear edge portions separated by a plurality of recesses which encompass 5 to 25% of the total blade length and 5 to 40% of the effective operating length of the blade and wherein said notched blade edge portions define a notch angle of between 20 and 80 degrees, as measured between the tangent thereto at its point of intersection with said rectilinear cutting edge portion and a line perpendicular to said rectilinear cutting edge portion.

8. A lap cutting blade according to claim 7, wherein the length of each of said recesses is between 10 to 20 times the blade thickness.

9. A lap cutting blade according to claim 8, wherein said recesses encompass about 25 to 35% of the effective operating length of said blade.

10. A lap cutting blade according to claim 8, wherein said recesses encompass 10 to 20% of the blade height.

11. A lap cutting blade according to claim 8, wherein said notch angle defined by said blade edge portions encompasses an angle of between 40 to 70 degrees.

12. A lap cutting blade according to claim 8, wherein said recesses are equidistantly spaced apart.

* * * * *